US011503896B2

(12) United States Patent
Savoye

(10) Patent No.: US 11,503,896 B2
(45) Date of Patent: Nov. 22, 2022

(54) BOTTLE WITH A ROLL-ON APPLICATOR AND A STOPPER

(71) Applicant: CHANEL PARFUMS BEAUTE, Neuilly-sur-Seine (FR)

(72) Inventor: Guillaume Savoye, Neuilly-sur-Seine (FR)

(73) Assignee: CHANEL PARFUMS BEAUTE, Neuilly-sur-Seine (FR)

( * ) Notice: Subject to any disclaimer, the term of this patent is extended or adjusted under 35 U.S.C. 154(b) by 0 days.

(21) Appl. No.: 17/280,041

(22) PCT Filed: Sep. 23, 2019

(86) PCT No.: PCT/FR2019/052220
§ 371 (c)(1),
(2) Date: Mar. 25, 2021

(87) PCT Pub. No.: WO2020/065189
PCT Pub. Date: Apr. 2, 2020

(65) Prior Publication Data

US 2022/0000244 A1 Jan. 6, 2022

(30) Foreign Application Priority Data

Sep. 26, 2018 (FR) ..... 1858802

(51) Int. Cl.
*A45D 34/04* (2006.01)
*A45D 40/22* (2006.01)
(Continued)

(52) U.S. Cl.
CPC ..... *A45D 34/041* (2013.01); *A45D 40/22* (2013.01); *A45D 40/261* (2013.01); *A45D 2040/225* (2013.01); *B05C 17/0207* (2013.01)

(58) Field of Classification Search
CPC .... A45D 34/041; A45D 40/261; A45D 34/04; A45D 40/26; A45D 40/22; A45D 40/221;
(Continued)

(56) References Cited

U.S. PATENT DOCUMENTS 2,912,708 A 11/1959 Schaich
3,055,041 A 9/1962 Schaich
(Continued)

FOREIGN PATENT DOCUMENTS

WO 2015/159017 10/2015

OTHER PUBLICATIONS

Official Communication issued in International Bureau of WIPO Patent Application No. PCT/FR2019/052220, dated Dec. 13, 2019, along with an English translation thereof.

*Primary Examiner* — David J Walczak
(74) *Attorney, Agent, or Firm* — Greenblum & Bernstein, P.L.C.

(57) ABSTRACT

A bottle including a reservoir for a liquid or semi-fluid product and a dispensing head projecting from the reservoir along a main axis. The dispensing head includes a roll-on applicator including a ball holder in which a ball is caged and from which a cap of the ball emerges. The bottle includes a rotary stopper suitable for covering the roll-on applicator in a closed position of the bottle, and for being released from the roll-on applicator for distributing product in an open position of the bottle. The ball holder is mounted translatably along the main axis, the roll-on applicator including an elastic component inserted between an applicator body and the ball holder. The ball moves in translation jointly with the ball holder to take a retracted position when the roll-on applicator is covered by the rotary stopper and a deployed position when the rotary stopper is released from the roll-on applicator.

9 Claims, 4 Drawing Sheets

(51) Int. Cl.
*A45D 40/26* (2006.01)
*B05C 17/02* (2006.01)

(58) Field of Classification Search
CPC ..... A45D 40/222; A45D 2040/225; A45D 2040/226; A45D 2040/227; B43K 7/00; B43K 7/005; B43K 23/08; B43K 23/12; B05C 17/02; B05C 17/0207; B05C 17/0217
USPC ..... 401/208, 212, 213, 214
See application file for complete search history.

(56) References Cited

U.S. PATENT DOCUMENTS 4,168,128 A * 9/1979 Fillmore ..... A45D 34/041 222/513
6,814,520 B1 * 11/2004 Delli Venneri ..... A45D 40/22 401/213
8,500,355 B2 * 8/2013 Liu ..... A61H 23/0263 401/209
2010/0329771 A1 12/2010 Zhang
2017/0027302 A1 2/2017 Cieux et al.

* cited by examiner

BOTTLE WITH A ROLL-ON APPLICATOR AND A STOPPER

BACKGROUND

1. Field of the Invention

The invention concerns the field of devices for dispensing and applying a perfume or a cosmetic, toiletry or care product. It relates in particular to devices for dispensing and application with a ball, commonly called "roll-on" applicators.

2. Description of the Background

In the present document, cosmetic products encompass all make-up products for the skin, lips or superficial appendages. Toiletry products comprise shower gels, bath products, body lotions, and deodorants. Perfumes designate in particular all perfuming or odoriferous compositions for application to the body. Care products comprise for example in particular products for application to the human or animal body for cleaning it, perfuming it, modifying the appearance thereof, or keeping it in a good state.

Roll-on applicators are commonly employed for dispensing and applying a liquid or semi-fluid product contained in a bottle equipped with such a dispenser. A roll-on dispenser bottle comprises a ball at the location of its dispensing neck, included in a ball holder or cage. The ball holder has a dispensing aperture in communication with the inside of the bottle. The ball is of greater diameter than that of the dispensing aperture. At a remote opposite location from the dispensing aperture of the bottle, the ball holder comprises a mouth. The ball is held in the ball holder, for example by a radial enclosing lip oriented towards the axis of revolution of the ball holder.

The ball is thus held in the ball holder, on the dispensing aperture, able to rotate freely. When the bottle is oriented with the ball downward, the product contained in the bottle reaches the ball and loads with product its surface that appears in the dispensing aperture. The rotation of the ball, for application of the product for example to the skin, enables the wetted surface of the ball to be placed at a remote opposite location from the dispensing aperture, in a position in which it is apparent and in contact with the application surface.

Ball applicators are thus simple devices which concomitantly enable the dispensing and application of a liquid or semi-fluid product. Nevertheless, they have certain drawbacks. They do not by themselves provide perfect sealing, in particular air-tightness that is often required for proper conservation of the product and/or to avoid the loss thereof, in particular through evaporation. More particularly, the clearance necessary for the free rotation of the ball in the ball holder does not allow such sealing.

It is known from the state of the art to associate a cap with the roll-on dispenser to provide sealing. The cap so associated is connected sealingly to the bottle or creates pressure on the ball, which provides sealing at the location of the dispensing aperture which forms a seat for the ball. Nevertheless, a cap connected to the bottle by screwing leads to a roll-on tip of large size, which is not always desirable, while a cap connected by snap engagement is of low reliability, or is difficult to put in place or remove.

SUMMARY

The invention is thus directed to providing a bottle comprising a roll-on tip making it possible to provide good sealing outside the phases of application of the product, and not having the aforementioned drawbacks of the devices known from the state of the art.

Thus, the invention relates to a bottle comprising a reservoir having an inner volume configured to contain a liquid or semi-fluid product and a dispensing head extending and projecting from the reservoir along a main axis, said dispensing head comprising a roll-on applicator comprising a ball holder in which a ball is caged with rotational freedom and from which a portion of the ball emerges on the opposite side from the reservoir. The bottle comprises a rotary stopper configured to cover the roll-on applicator in a closed position of the bottle, and to be clear of said roll-on applicator for the dispensing of the product in an open position of the bottle. The rotary stopper is able to rotate relative to the rest of the bottle about a rotational axis crossing said main axis perpendicularly. The roll-on applicator comprises an applicator body in which the ball holder is mounted for translational movement along the main axis, and in which an elastic component is interposed between the applicator body and the ball holder. The roll-on applicator comprises an elastic component and is configured such that the ball can move in translation together with the ball holder along the main axis to adopt a position retracted into the dispensing head when the roll-on applicator is covered by the rotary stopper in closed position of the bottle, said elastic component being compressed, and to adopt a position extended out of the dispensing head under the effect of relaxing of the elastic component when the rotary stopper is clear of the roll-on applicator.

The use of a rotary stopper thus connected to the rest of the bottle, for example to the reservoir or to the dispensing head (for example to a neck of the bottle), directly over the ball of the roll-on applicator, enables the desired sealing to be obtained, without requiring the use of a voluminous applicator. Furthermore, the stopper is more reliable than a cap fitting by snap engagement, and cannot be lost since it is connected to the rest of the bottle both when it is closed and when it is open. A configuration in which the elastic component is interposed between an applicator body and the ball holder enables the use of a simple and reliable elastic component (for example a helical spring), which is not exposed to the product dispensed; It also enables a large range of movement for the ball between the closed position of the bottle and its extended position. This enables a bottle to be obtained that is both compact when it is closed and which enables easy application of the product when the ball is extended.

The ball holder may comprise a conveying duct for product extending along the main axis towards the inner volume and the applicator body may comprise an upper volume separated from the inner volume of the reservoir by a partition comprising a well at its center which is closed in a lower part by a bottom, the walls of the well comprising at least one opening, said bottle being configured such that when it is in closed position the conveying duct closes off said opening and when it is in open position said opening is clear.

The elastic component may for example be a helical spring.

The rotary stopper may comprise a crowning member in which is disposed a stopper member comprising a concavity of complementary shape to that of the portion of the ball projecting from the ball holder.

The stopper member may comprise a resilient member.

The stopper member may have chamfered ribs parallel to the rotational axis of the rotary stopper, the chamfers so formed coming into contact with the ball on passage from the open position to the closed position.

The reservoir may have an outer shape of a solid of revolution, said rotational axis of the rotary stopper coinciding with an axis of revolution of the outer shape of the reservoir. The reservoir may in particular have an outer shape of a cylinder of which the height is less than or equal to its radius.

Still other particularities and advantages of the invention will appear in the following description.

BRIEF DESCRIPTION OF DRAWINGS

In the accompanying drawings, given by way of non-limiting example.

DETAILED DESCRIPTION

Figure 1:
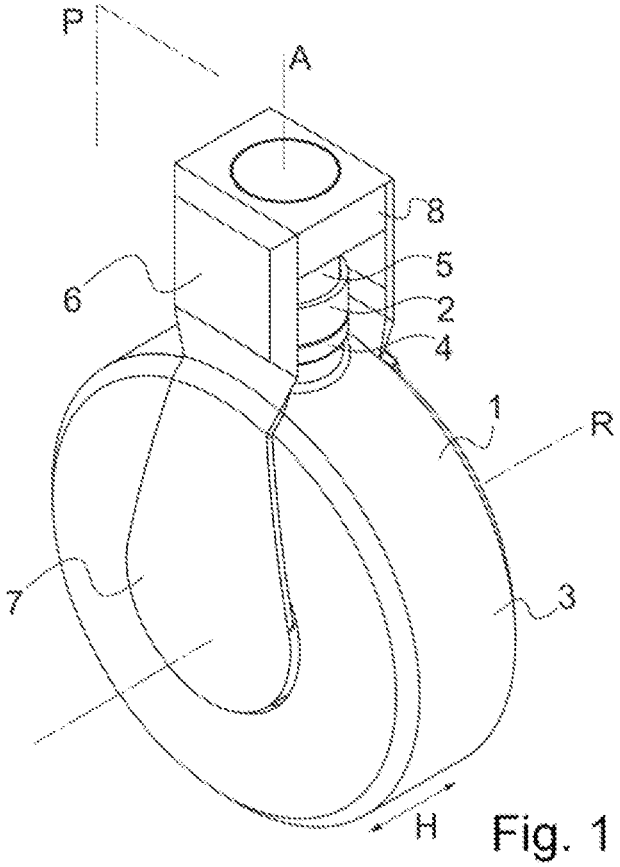
FIG. 1 shows, in a diagrammatic view in three dimensions, a bottle in accordance with an embodiment of the invention.

FIG. 1 shows a bottle in accordance with a preferred, but not exclusive, embodiment of the invention. The bottle comprises a reservoir 1 able to contain a liquid or semi-fluid product. The bottle of the invention is in particular provided to contain a perfume or a cosmetic, toiletry or care product.

The reservoir of the bottle of the invention may thus have a capacity (inner volume provided to receive the product) comprised between 10 mL and 500 mL, in particular 20 mL, 35 mL, 75 mL, 100 mL, or 200 mL.

In the example shown here, the reservoir has a shape of a flattened cylinder of revolution. The qualifying term flattened indicates that the cylinder has the shape of a disk, or a height H that is small compared with its diameter. Typically, the reservoir 1 has a thickness (corresponding to the height H of the cylinder it defines) less than or equal to its radius r.

The bottle further comprises a dispensing head 2. The dispensing head 2 is positioned on the edge surface of the reservoir 1 of the bottle shown here, that is to say on the lateral wall 3 of the cylindrical reservoir 1 from which it projects. The dispensing head 2 comprises a neck 4 in which is assembled a roll-on applicator 5. The dispensing head extends in a general direction of extension which a main axis A of the bottle embodies.

In order to cover the roll-on applicator 5 to provide the sealing of the bottle, the bottle of the invention comprises a stopper 6 which is rotary, that is to say which is able to rotate relative to the rest of the bottle, and of which the operation is described in more detail below.

The rotary stopper essentially consists of a crowning member which is able to rotate relative to the rest of the bottle, that is to say relative to the reservoir 1 as in the embodiment shown or as the case may be relative to the dispensing head 2. The rotary stopper has the general form of an arch comprising two upright members 7 connected together by a crosspiece forming a crowning member 8.

The upright members 7 have a rotational connection to the reservoir 1.

Figure 2:
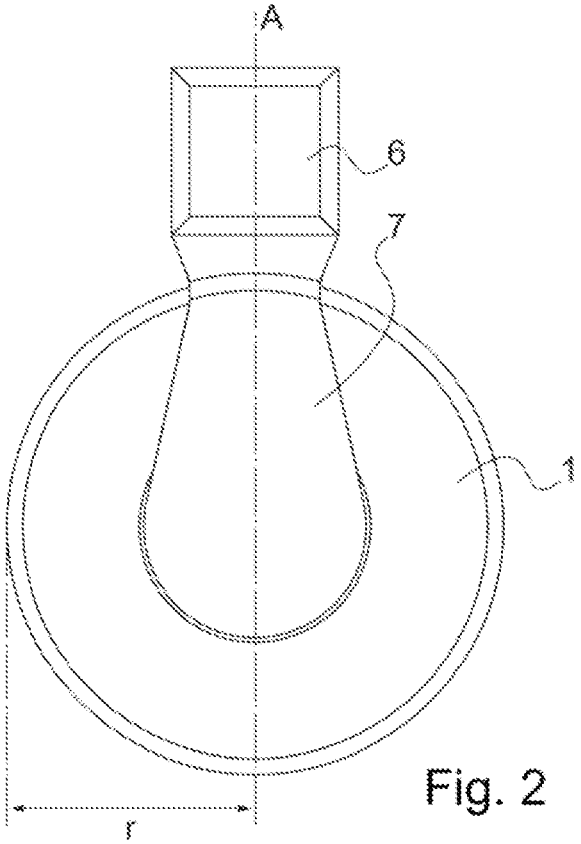
FIG. 2 shows a side view of the bottle of FIG. 1 in closed position.
Figure 3:
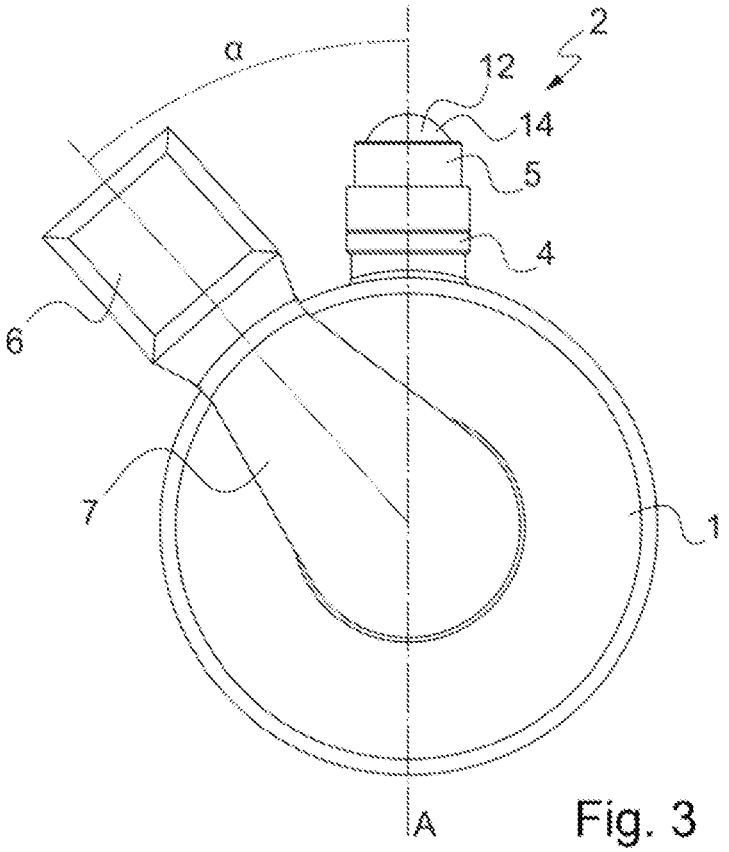
FIG. 3 shows, in a view similar to that of FIG. 2, the bottle of FIGS. 1 and 2 in open position.

This enables the rotary stopper 6 to be rocked between a closed position of the bottle shown in FIGS. 1 and 2, and an open position of the bottle shown in particular in FIG. 3.

In the closed position, the rotary stopper 6 is aligned with the main axis A, RPM such that the crowning member 8 covers the ball 12. In the open position, the rotary stopper 6 can have any position in which it does not cover the roll-on applicator, that is to say, any position in which the roll-on applicator is freed and enables the application of the product present in the bottle. In other words, the angular position of the rotary stopper 6 relative to the main axis A is not necessarily unique. The angular position of the rotary stopper is in particular defined by the angle $\alpha$ between the main axis A and the axis connecting the point of intersection between the rotational axis of the rotary stopper and said main axis and the center of the crowning member 8 of the rotary stopper 6.

A favored and stable open position may be defined, according to a variant not shown, by a notch formation provided between the rotary stopper 6 and the reservoir 1.

In the embodiment shown, the rotational axis R of the rotary stopper coincides with the axis of revolution of the reservoir 1. In open position of the bottle, the rotary stopper can have any angular position in which it does not cover the roll-on applicator 5. In particular, on account of the solid of revolution shape of the reservoir, the rotary stopper may be turned through 360° in order to open then close the bottle again. The user can position the rotary stopper in the angular position which appears to her the most appropriate for the application of the product.

Figure 4:
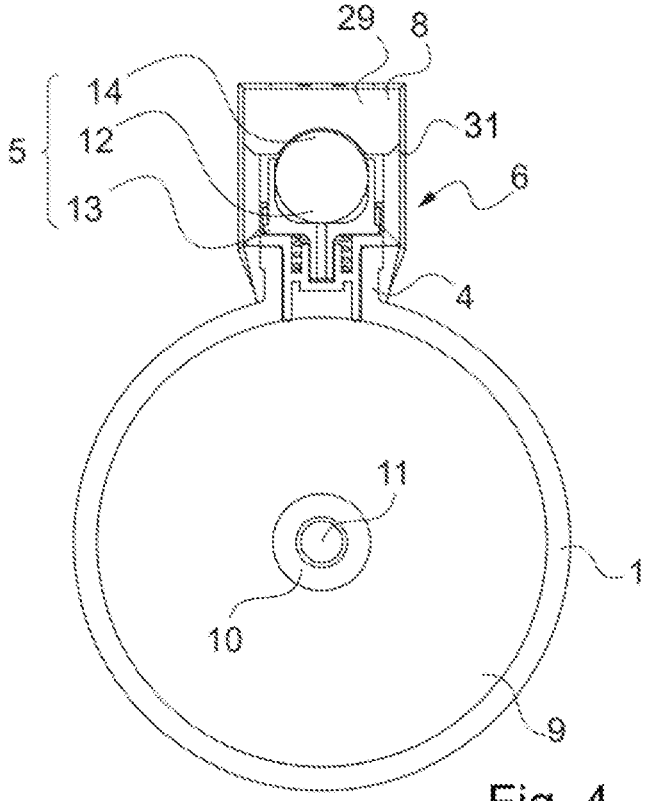
FIG. 4 shows a cross-section view of the bottle of FIGS. 1 to 3 in closed position.

FIG. 4 comprises the bottle of FIG. 2, in closed position, seen in a cross-section on a transverse plane P shown in FIG. 1. The reservoir 1, which has a cylindrical outer general shape, forms an inner volume 9 provided to contain the liquid or semi-fluid product to dispense. An inside wall 10 forms a passage for an axle 11 of the rotary stopper 6, the axle 11 coinciding with the rotational axis R.

Figure 5:
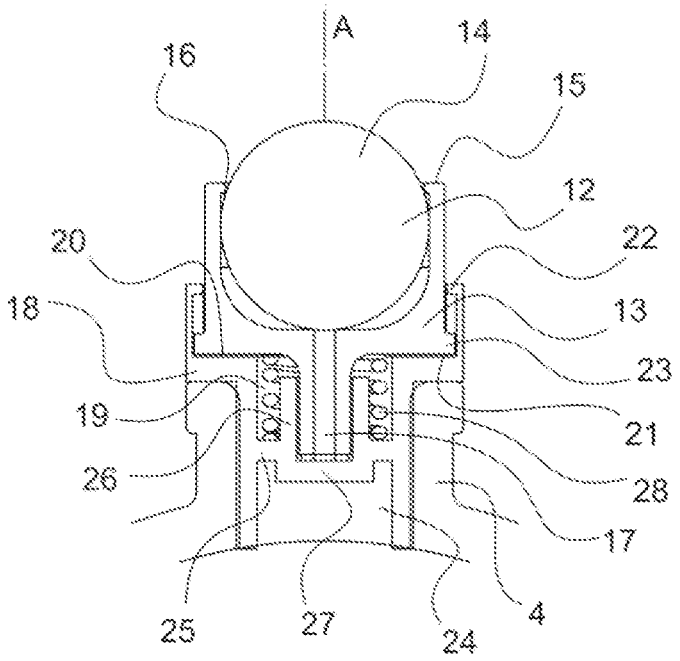
FIG. 5 is a detail view of FIG. 4.

FIG. 5 is a detail view of FIG. 4, at the location of the roll-on applicator 5. The roll-on applicator comprises a ball 12, which is held in a ball holder 13. The ball 12 is translationally fixed in the ball holder 13 but can turn therein freely. The ball 12 is thus caged into the ball holder 13. A portion 14 of the ball juts, or emerges, from an upper face 15 of the ball holder 13. The upper face 15 is typically embodied by a lip 16 for holding the ball 12 in the ball holder 13. The portion 14 constitutes the application surface of the roll-on applicator, that is to say, the surface able to be placed contact for example with the user's skin in order to apply the product thereto. The ball holder 13 comprises a conveying duct 17. The conveying duct 17 enables the ball 12 to be supplied with product coming from the reservoir 1. In particular, the conveying duct 17 opens into the ball holder 13 so as to load the surface of the ball 12 with product, that surface loaded with product being able to pass into the emerged part of the ball (portion 14) under the effect of a rotation of the ball in the ball holder 13.

The conveying duct 17 is typically centered on the main axis A.

The ball holder is mounted to have translational mobility along the main axis A, in an applicator body 18.

The applicator body 18 is permanently fastened in the neck 4 of the bottle. The applicator body 18 comprises an upper volume 19 in which the ball holder 13, and thus on a corollary basis, the ball, is able to move translationally. The movement of the ball holder in the applicator body is limited in relation to pushing-in or retraction (that is to say towards the inside of the reservoir 1) by a bearing surface 20 forming a stop for a lower surface 21 of the ball holder 13, and in extension by an upper ring 22 forming a stop for a flange 23 of the ball holder 13.

The applicator body is configured such that its upper volume 19 is separated from an optional inner volume 24, and thus from the inner volume of the reservoir by a partition 25 comprising at its center a well 26 which is closed in a lower part by a bottom 27, the walls of the well comprising at least one opening (that is to say a through-aperture). When the bottle is in closed position, the conveying duct 17 closes off the apertures of the well, and when it is in open position, the apertures are clear. This improves the sealing of the bottle.

An elastic member, i.e. in the example shown a helical spring 28, tends to place the ball holder 13 and the ball 12 in extended position, in which the flange 23 bears under the upper ring 22. Thus, the ball holder 13 and the ball 12 adopt the extended position, illustrated in FIGS. 6 and 7 described below, under the effect of the elastic member, in the absence of other mechanical stresses applied on the ball 12 or the ball holder 13.

Thus, the retracted position shown in FIG. 5 must be maintained wider effect of a return force pushing the ball back towards the reservoir 1. The return force is typically applied by the rotary stopper 6 (in particular when it covers the roll-on applicator as shown in FIG. 4). For the sake of clarity of the drawings, the rotary stopper is not shown in FIG. 5.

In the closed position of the bottle, the helical spring 28 is compressed between the lower surface 21 of the ball holder 13 and a surface of the applicator body 18.

The rotary stopper thus presses on the ball 12 when the bottle is in closed position. To that end, the crowning member 8 comprises a stopper member 29, in which is provided a concavity 30 of shape complementary to that of the portion 14 of the ball 12 that projects from the ball holder 13.

This shape complementarity enables the stopper member 29 to bear on the upper face 15 of the ball holder when the ball is engaged in its concavity 30, which provides sealing for the bottle when it is in closed position. The interaction between the ball and the concavity also enables the stopper to be held in a stable angular position when the bottle is closed.

The stopper member 29 is ideally formed from a resilient material, which improves the sealing of the bottle and facilitates the passage between the open position and the closed position of the bottle.

Figure 6:
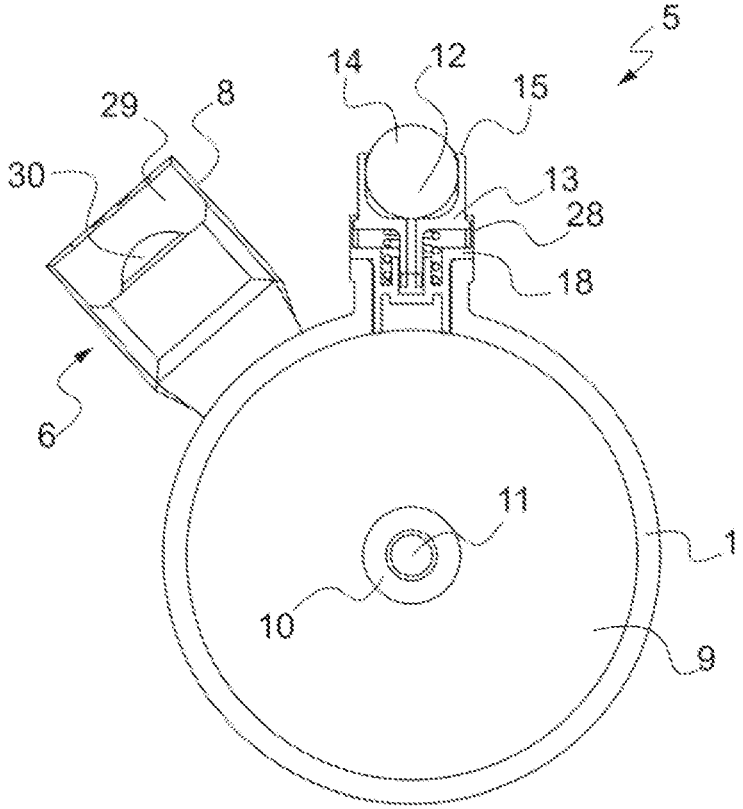
FIG. 6 shows a cross-section view of the bottle of FIGS. 1 to 5 in open position.
Figure 7:
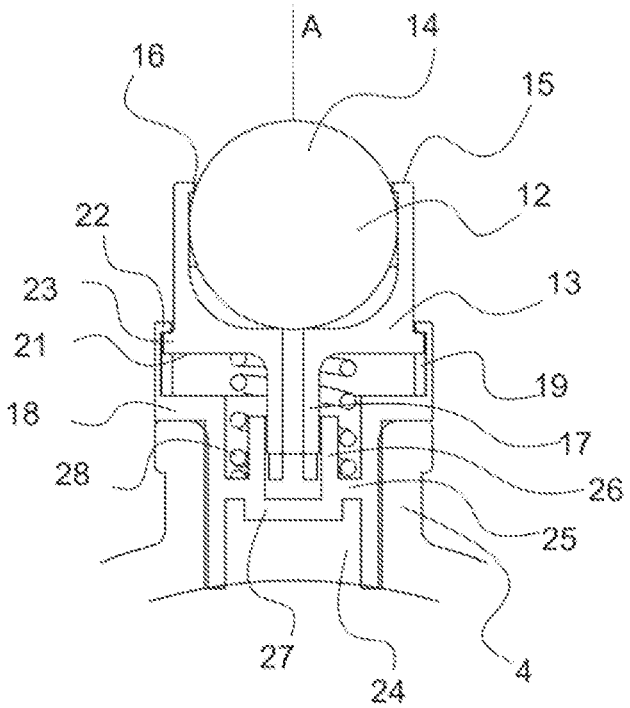
FIG. 7 is a detail view of FIG. 6.

In the open position illustrated in FIGS. 6 and 7, the rotary stopper 6 has been cleared from the dispensing head 2 and in particular from the roll-on applicator 5. In relaxing, the helical spring 28 pushes away the ball holder 13 and the ball 12 into extended position, in which the flange 23 of the ball holder 13 bears under the upper ring 22 of the applicator body 18.

This extended position offers the user greater ease of application, as well as flexibility given by the helical spring which is appreciable during application. Furthermore the placing in extended position of the roll-on applicator clears the conveying duct 17 of the apertures formed in the well 26 of the applicator body 18, which enables the passage into the conveying duct 17 of the product coming from the reservoir 1 and the supply with product of the surface of the ball 12.

Figure 8:
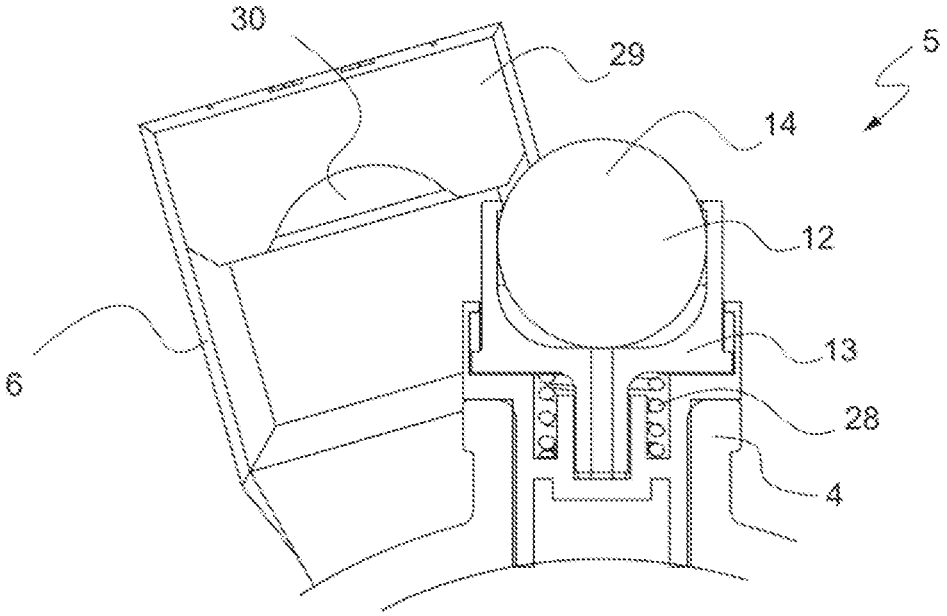
FIG. 8 shows, in a cross-sectional detail view, the roll-on applicator of the bottle of FIGS. 1 to 7, on passage from the open position to the closed position of the bottle.

FIG. 8 shows, in a cross-sectional detail view, the roll-on applicator of the bottle of FIGS. 1 to 7, on passage from the open position to the closed position of the bottle.

In FIG. 8, the roll-on applicator 5 is in retracted position. The passage from the extended position to the retracted position is facilitated by chamfers 31 provided on the crowning member 8. In particular, the stopper member 29 has chamfered ribs parallel to the rotational axis of the rotary stopper, such that the chamfers 31 come into contact with the ball holder and/or with the ball on passage from the open position to the closed position. More specifically, the chamfers 31 are positioned and configured such that they form the first surface in contact with the roll-on applicator on closing of the bottle, so as to orient the force arising from that contact substantially towards the inside of the bottle, and thereby facilitate the retraction of the ball holder 13 and of the ball 12.

Alternatively, the chamfers 31 may be replaced by other shapes making it possible to avoid an abruptly shaped rib of the stopper component 29 coming into contact with the ball 12. For example rounded formations or fillets may be formed.

Although the invention has been described with reference to a particular embodiment, it is of course not limited solely to that embodiment.

In particular, a specific shape of reservoir has been described in detail, but other shapes may be envisioned in the context of the present invention, in particular any shape of a solid of revolution including spherical, an oval or ovoid shape, a parallelepiped shape which may or may not be surmounted with a rounded shape such as a half-disk, etc.

The axle 11 may alternatively be replaced by two cylindrical projections formed on the inside faces (located towards the reservoir 1) of the uprights 7 of the rotary stopper 6, so as to be inserted in respective opposite ends of the passage formed by the inside wall 10. In this case, the passage may be replaced by two cavities formed in the wall of the reservoir 1. Still other means enabling the rotation of the rotary stopper may be envisioned without departing from the scope of the invention. For example, a protrusion that is circular or that forms a circle arc may be formed on each of the inside faces of the uprights 7. The protrusion is engaged in a groove which is circular or that forms a circle arc, of corresponding radius and formed in the wall of the reservoir 1.

Similarly, the rotational axis of the rotary stopper may be formed at the location of any part of the bottle, in particular the dispensing head.

The helical spring of the embodiment described above may be replaced by any suitable elastic component, among which are blade springs and members of resilient materials such as rubber or silicone, or may have a different disposition from that presented in the invention.

Furthermore, the bottle may have a roll-on applicator of which only the ball (and not the assembly comprising the ball and the ball holder) is movable between the open position and the closed position. The bottle may have a fixed roll-on applicator, the resilient or movable members enabling the closing and sealing of the bottle being offset into the crowning member of the rotary stopper.

The bottle thus developed in the invention provides, thanks to the use of a rotary stopper, a roll-on applicator that is compact and fluid-tight when the bottle is in closed position, while benefitting from great ease of use. It moreover has the advantage of providing a stopper that cannot be lost. Lastly, the alternative to the stoppers known in the prior art that is given by the present invention, in certain embodiments, make it possible to obtain a bottle having aesthetics that are distinctive and attractive for the user.

The invention claimed is:

1. A bottle comprising:

a reservoir having an inner volume configured to contain a liquid or semi-fluid product;

a dispensing head extending and projecting from the reservoir along a main axis;

the dispensing head comprising a roll-on applicator including a ball holder;

a ball being caged with rotational freedom within the ball holder and a portion of the ball being configured to emerge in a direction along the main axis on an opposite side of the ball holder from the reservoir;

a rotary stopper configured to cover the roll-on applicator in a closed position of the bottle, and configured to be clear of said roll-on applicator for the dispensing of the product in an open position of the bottle;

the rotary stopper not having an opening through which the portion of the ball is configured to emerge;

the rotary stopper being configured to rotate in relation to a remainder of the bottle about a rotational axis crossing the main axis, perpendicularly;

the roll-on applicator further comprising an applicator body, the ball holder being mounted in the applicator body for translational movement along the main axis;

the roll-on applicator comprising an elastic component interposed between the applicator body and the ball holder;

the roll-on applicator being configured such that the ball is movable in translation together with the ball holder along the main axis to adopt a position retracted into the applicator body when the roll-on applicator is covered by the rotational stopper in the closed position of the bottle, said elastic component being compressed, and to adopt a position extended out of the dispensing head under an effect of relaxing of the elastic component when the rotary stopper is clear of the roll-on applicator.

2. The bottle according to claim 1, wherein:

the ball holder comprises a conveying duct for a product extending along the main axis towards the inner volume;

the applicator body comprises an upper volume separated from the inner volume of the reservoir by a partition comprising a well at a center of the partition that is closed in a lower part by a bottom;

the well having walls comprising at least one opening and the bottle being configured such that, in the closed position of the bottle, the conveying duct closes off the opening and, in the open position of the bottle, the opening is clear.

3. The bottle according to claim 1, wherein:

the elastic component is a helical spring.

4. The bottle according to claim 1, wherein:

the stopper member comprises a resilient member.

5. The bottle according to claim 1, wherein:

the reservoir has an outer shape of a solid of revolution, said rotational axis of the rotary stopper coinciding with an axis of revolution of the outer shape of the reservoir.

6. The bottle according to claim 5, wherein:

the reservoir has an outer shape of a cylinder, said cylinder having a height less than or equal to a radius of the cylinder.

7. The bottle according to claim 1, wherein:

the rotary stopper comprises a crowning member;

a stopper member is disposed in the crowning member, the crowning member comprising a concavity of complementary shape to a shape of the portion of the ball projecting from the ball holder.

8. The bottle according to claim 7, wherein:

the stopper member has chamfered ribs parallel to the rotational axis of the rotary stopper, the chamfers being so formed coming into contact with the ball on passage from the open position to the closed position.

9. The bottle according to claim 1, wherein:

the rotary stopper comprising a crowning member;

a stopper member being disposed in the crowning member;

the stopper member comprising a concavity of complementary shape to a shape of the portion of the ball emerging from the ball holder, the stopper member having chamfered or rounded ribs parallel to the rotational axis of the rotary stopper; and one of the chamfered or rounded ribs being positioned and configured such that the one of the chamfered or rounded ribs forming a first surface in contact with the ball on passage from the open position to the closed position, so as to orient a force arising from said contact towards an inside of the bottle, and thereby facilitate retraction of the ball holder and of the ball.

* * * * *